United States Patent [19]

O'Flaherty

[11] Patent Number: 4,741,228

[45] Date of Patent: May 3, 1988

[54] STUD EXTRACTOR

[76] Inventor: Lawrence J. O'Flaherty, 742 S. Seventh St., Upper Sandusky, Ohio 43351

[21] Appl. No.: 44,100

[22] Filed: Apr. 30, 1987

[51] Int. Cl.[4] ..... B25B 13/50

[52] U.S. Cl. ..... 81/53.2; 81/446

[58] Field of Search ..... 81/53.2, 443, 446; 74/567

[56] References Cited

U.S. PATENT DOCUMENTS

| | | | |
|---|---|---|---|
| 1,887,009 | 11/1932 | Buttress | 81/446 |
| 2,482,501 | 9/1949 | Oravetz | 81/446 |
| 3,861,251 | 1/1975 | Streander | 81/443 |
| 4,197,889 | 4/1980 | Peterson | 81/446 |
| 4,335,632 | 6/1982 | Irwin | 81/446 |

*Primary Examiner*—Frederick R. Schmidt

*Assistant Examiner*—Bradley I. Vaught

*Attorney, Agent, or Firm*—Biebel, French & Nauman

[57] ABSTRACT

A stud extractor for removing a stud embedded in a structure includes a shaft having an end portion adapted to be grasped by a tool and a body having a plurality of longitudinally-extending, convex camming surfaces and a pin having a plurality of rod portions positioned adjacent to the camming surfaces and joined by bridge elements to form a pocket for receiving the body of the shaft. The pin and shaft are inserted into a bore formed in a stud to be extracted and the shaft is rotated relative to the pin and stud. This causes the camming surfaces to jam the rod portions of the pin against the wall of the bore to prevent further relative rotation and cause the stud to rotate with the shaft. In a preferred embodiment, the pin includes an upper lip which prevents the pin from sliding completely into the bore of the stud.

10 Claims, 2 Drawing Sheets

STUD EXTRACTOR

BACKGROUND OF THE INVENTION

The present invention relates to devices for removing studs from a larger structure within which they are embedded, and, more particularly, to stud extractors for removing threaded and non-threaded studs which are flush with or recessed from the surface of the larger structure.

It is often necessary to remove studs from a matrix or larger structure within which they are embedded. Frequently, the stud is a threaded bolt whose head has been sheared off so that the shank of the bolt is flush with the surface of the larger structure, thereby making it impossible for the shank to be grasped by a tool such as a pair of pliers, a wrench, or the like. A common method of removing such embedded studs is to form a bore through the center of the stud, then insert a drill bit having reverse threads which bite into the wall of the bore and cause the stud to rotate with it, thereby backing the stud out of its threaded hole.

While this method is direct and uncomplicated, its application is somewhat limited. For example, should the stud be a smooth cylinder press fit into a bore, it may not be possible to remove the stud by the use of a threaded engagement between the stud and the stud extractor; the stud may simply turn within its bore. Furthermore, a stud may itself have reverse threads, requiring a bore to be drilled with a bit having reverse threads, then inserting a bit having right-hand threads to remove the stud.

A stud-removing device is shown in Royer et al. U.S. Pat. No. 2,600,924. That device includes a drill bit having projections for engaging the top surface of a stud which is flush with a supporting structure, and axially projecting lugs which are inserted into the bore formed in the stud to help center the bit as it is rotated. The projections dig into the stud as the drill bit is turned, causing the stud to rotate in a reverse direction and back out of its hole. A disadvantage of this device is that it requires a large surface area surrounding the bore formed in the stud to provide a surface to be engaged by the drill bit projections.

Accordingly, there is a need for a stud extractor which has applications in both right- and left-hand threaded studs, smooth studs, and studs which have broken off below the surface of the supporting structure or are located within recessed bores. Furthermore, there is a need for a stud extractor which requires a minimum of stud surface area to operate.

SUMMARY OF THE INVENTION

The present invention is a stud extractor shaped to be inserted into a bore formed in a stud to be extracted and includes a shaft having an end portion adapted to be grasped by a tool and a body portion having a plurality of camming surfaces, and a pin shaped to engage the camming surfaces such that rotation of the shaft causes the body to jam the pin against the wall of the bore and prevent relative rotation between the shaft and stud, thereby causing the stud to rotate with the shaft. In a preferred embodiment, the camming surfaces are convex in shape and the pin includes a plurality of rod portions, each extending along a different one of the camming surfaces. Rotation of the shaft in either a clockwise or counterclockwise direction causes the camming surfaces to urge the rod elements outwardly to jam against the wall of the bore. Accordingly, the stud extractor of the present invention can be used to remove either right- or left-hand threaded studs.

Also in the preferred embodiment, the shaft body includes three camming surfaces joined to form a triangular shape in cross-section, and the pin includes three rod portions oriented parallel to each other and forming a pocket for receiving the shaft body. The first and second rod portions are joined by an upper bridge element which is arcuate in shape to allow the body to enter the pocket, and protrudes outwardly from the pin to form a lip for supporting the pin near the top of the bore in the stud. The second and third rod elements are joined by a lower bridge element which extends across the pocket and prevents the shaft from sliding through the pocket and further into the bore.

The pin preferably is made of half-round spring steel having a knurled, flat side and is formed such that the flat side is facing radially outwardly so that a rather sharp, longitudinal edge is positioned to dig into the wall of a bore as the shaft is rotated. The shaft preferably is made of tool steel and the end portion has a hexagonal shape in cross-section sized to receive a standard socket from a socket wrench.

To use the stud extractor of the present invention, a bore of an appropriate size is first drilled into the stud to be extracted. The pin is inserted into the stud until the upper lip rests upon the top surface of the stud and the body portion of the shaft is then inserted into the pocket of the pin until the end face of the body portion rests against the lower bridge element. The shaft is then grasped by a tool such as a socket wrench, and rotated either in a clockwise or counterclockwise direction.

The rotation of the camming surfaces of the body portion relative to the pin causes the rod portions to be urged radially outwardly until they are jammed against the wall of the bore. Further relative rotation of the shaft with respect to the pin and stud is prevented, whereupon the stud begins to rotate with the shaft and back out of the bore within which it is located. The gripping force of the extractor is sufficient to permit the extractor to reverse.

Accordingly, it is an object of the present invention to provide a stud extractor which can be used with either unthreaded, right- or left-hand threaded studs; a stud extractor which does not require a stud to have a large exposed surface; and a stud extractor which is relatively simple and rugged in construction.

Other object and advantages of the present invention will be apparent from the following description, the accompanying drawings, and appended claims.

DETAILED DESCRIPTION OF THE PREFERRED EMBODIMENT

Figure 1:
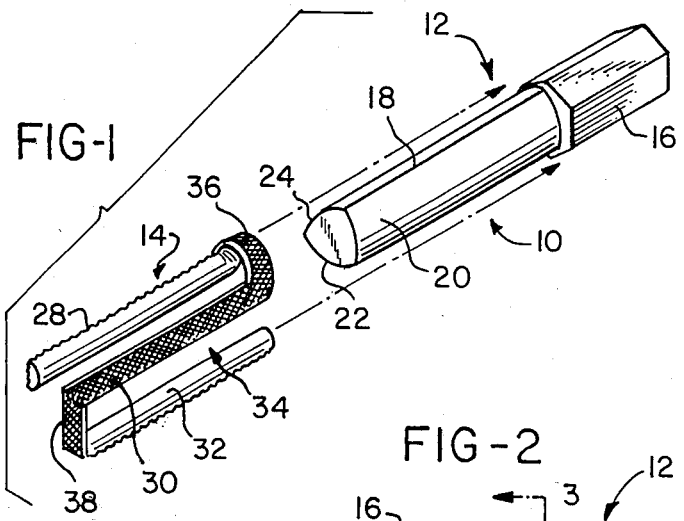
FIG. 1 is an exploded, perspective view of a preferred embodiment of the stud extractor of the present invention.
Figure 2:
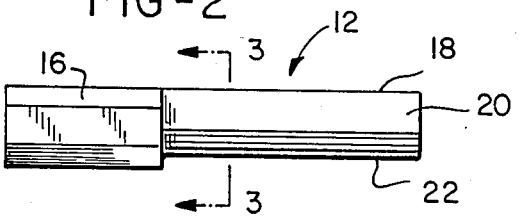
FIG. 2 is a side elevation in section of the shaft of FIG. 1.

As shown in FIG. 1, the stud extractor of the present invention, generally designated 10 includes a shaft 12 and a pin 14. The shaft 12, also shown in FIGS. 2 and 3, includes an end portion 16 having a hexagonal shape in cross-section and sized to be received within a standard hex socket.

Figure 3:
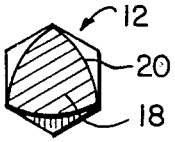
FIG. 3 is a cross-section of the shaft taken at line 3—3 of FIG. 2.
Figure 4:
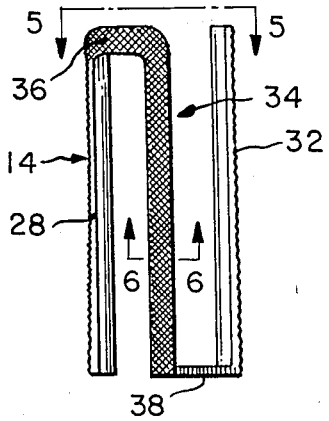
FIG. 4 is a side elevation of the pin of FIG. 1.
Figure 5:
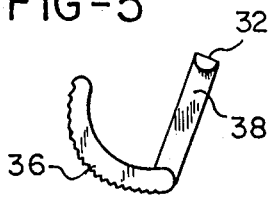
FIG. 5 is a top plan view of the pin, taken at line 5—5 of FIG. 3.

The shaft 12 includes a body portion 18 having three camming surfaces 20, 22, 24. Each of the camming surfaces 20–24 is convex in shape and extends longitudinally of the body portion 18. As shown in FIG. 3, the camming surfaces 20–24 form a triangular shape in cross-section. As shown in FIGS. 1, 4, and 5, the pin 14 includes three rod portions 28, 30, 32. The rod portions 28–32 are positioned parallel to each other and form a pocket 34 sized to receive the body portion 18.

Figure 6:
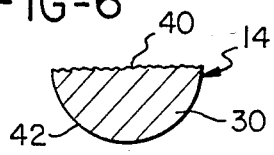
FIG. 6 is a radial cross-section of the pin taken at line 6—6 of FIG. 3.

Rod portions 28 and 30 are connected by a bridge element 36, also shown in FIG. 6, which extends between the upper ends of the rod portions. Bridge element 36 is arcuate in shape and provides clearance to allow the body portion 18 to be inserted into the pocket 34. Furthermore, bridge 36 protrudes outwardly from the pin 26 to form a lip. A second bridge element 38 is attached to and extends between rod portions 30 and 32. Bridge element 38 extends across the opening forming the pocket to provide a stop which prevents the body portion 18 from extending completely through the pocket.

In the preferred embodiment, the pin 14 consists of a continuous length of spring steel having a half-round shape in cross-section and in which the flat side 40 is knurled. The half-round wire is formed into the pin such that the flat side 40 faces radially outwardly, and the round side 42 faces inwardly and engages the camming surfaces 20–24 of the body portion 18.

Figure 7:
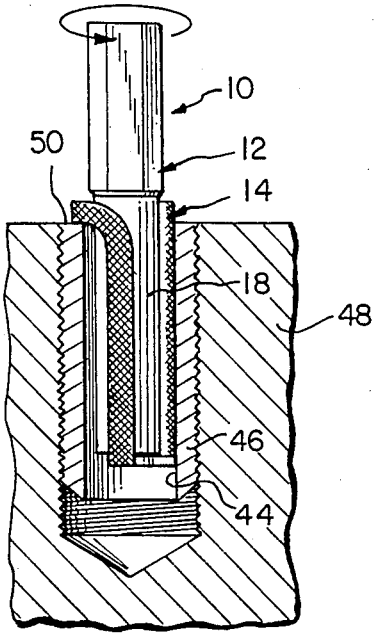
FIG. 7 is a side elevation of the stud extractor of FIG. 1, shown within a stud, partially in section, that is threaded into a larger structure, in section.

The operation of the stud extractor 10 is as follows. As shown in FIG. 7, it is necessary first to drill a bore 44 into the stud 46 to be extracted. Although the stud 46 shown in FIG. 7 is threaded into a retaining structure 48, it is to be understood that the stud extractor 10 may be used with a stud which is slightly press fitted into its retaining structure as well.

The next step in the method is to insert the pin 14 into the bore 44. It should be noted that the bore should be sized such that the rod portions 28–32 of the pin contact the wall of the bore. The pin 14 is pressed into the bore 44 until the lip formed by the bridge element 36 contacts the top surface 50 of the stud 46.

Figure 8:
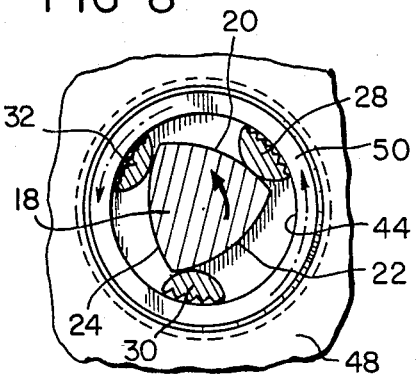
FIG. 8 is a schematic cross-sectional view of the stud extractor of FIG. 7 as the shaft is rotated counter-clockwise.
Figure 9:
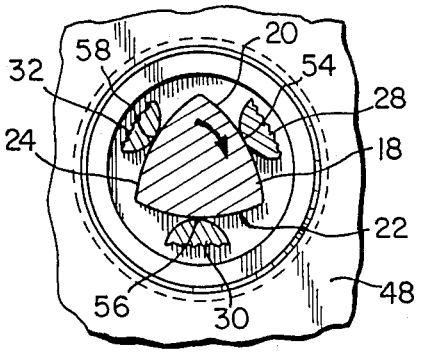
FIG. 9 is a schematic cross-sectional view of an alternate embodiment of the invention.

The shaft 12 is now inserted into the bore 44 such that the body portion 18 is oriented to place the camming surfaces 20–24 into contact with each of the rod portions 28–32, as shown in FIGS. 8 and 9. A hex socket is attached to the end portion 16 of the shaft 12 and is rotated in a counterclockwise direction—assuming the stud 46 is threaded into the retaining structure 48 with right-handed threads—as shown in FIG. 8. The torque applied to the shaft 12 causes the shaft to rotate slightly relative to the pin 14 and stud 46. This rotation causes the convex camming surfaces 18–24 to urge the rod portions 28–32 radially outwardly, jamming them against the wall of the bore 44. The shaft 12 is now locked against the stud 46, and further rotation of the shaft causes the pin 26 and stud 46 to rotate with it, backing the stud out of its threaded bore 52. FIG. 9 shows that the same effect is achieved by rotating the shaft 12 clockwise, and would be used to remove a stud having left-handed threads.

FIG. 9 also shows an alternate embodiment of the invention, in which the camming surfaces 20′, 22′, 24′ of a shaft 12′ include flats 54, 56, 58, respectively. By forming flats 54–58 on the surfaces 20′–24′, a larger diameter shaft 12′ may be used for a given bore 44, so that the extractor 10′ allows a greater amount of torque to be applied to a stud 46.

While the form of apparatus herein described constitutes a preferred embodiment of this invention, it is to be understood that the invention is not limited to this precise form of apparatus, and that changes may be made therein without departing from the scope of the invention.

What is claimed is:

1. A stud extractor for removing a stud embedded in a structure comprising:

a shaft having an end portion adapted to be grasped by a tool and a body having a plurality of longitudinal camming surfaces; and pin means for engaging said body at said camming surface, said pin means comprising a plurality of rod portions formed from a continuous length of metallic wire which also forms first and second bridge elements at respective upper and lower ends of said rod portions for maintaining said rod portions in the form of a pocket for receiving said body, whereby rotation of said body relative to said pin means within a bore formed in a stud causes the rod portions of said pin means to be jammed against a wall of said bore by said camming surfaces, such that relative rotation between said shaft and said stud is prevented and said stud rotates with said shaft.

2. The stud extractor of claim 1 wherein at least one bridge of said pin means includes upper lip means for preventing said pin means from sliding completely into said bore.

3. The stud extractor of claim 2 wherein each of said camming surfaces includes a flat portion extending longitudinally along a midportion thereof, whereby said shaft is capable of making a tight fit with said bore.

4. The stud extractor of claim 1 wherein a first and a second one of said rod portions are joined by said first bridge element extending between upper ends thereof, said first bridge element being arcuate in shape and forming upper lip means for preventing said pin means from sliding completely into said bore.

5. The stud extractor of claim 4 wherein a third one of said rod portions is joined to said second rod portion by said second bridge element attached to and extending between lower ends of said second and third rod portions.

6. The stud extractor of claim 5 wherein said rod portions are substantially parallel to each other and form a pocket shaped to receive said body therein, said first bridge element being positioned to allow said body to enter said pocket.

7. The stud extractor of claim 6 wherein said second bridge element is positioned to extend across a bottom of said pocket to prevent said body from sliding past said bottom of said pocket.

8. The stud extractor of claim 1 wherein said metallic wire is half round and formed such that a flat side thereof faces outwardly to engage said bore.

9. The stud extractor of claim 8 wherein said flat side is knurled.

10. A stud extractor for removing a stud embedded in a structure comprising:

a shaft having an end portion adapted to be grasped by a tool and a body having three longitudinally extending, substantially convex camming surfaces joined to form a triangular shape in cross-section, each of said surfaces having a longitudinally-extending flat portion extending along a centerline thereof;

pin means for engaging said body at said camming surfaces, said pin means including first, second and third rod portions oriented parallel to each other forming a pocket therebetween receiving said body such that said rod portions engage and extend along different ones of said camming surfaces, a first bridge element attached to and extending between upper ends of said first and second rod portions and being arcuate in shape to allow said body to enter said pocket and protrude from said pin means sufficiently to provide a lip to engage an upper surface of a stud to be removed and prevent said pin means from sliding down a bore formed in said stud for receiving said extractor, and a second bridge element attached to and extending between lower ends of said second and third rod portions to close said pocket and prevent said shaft from sliding therethrough, said pin means being made of half-round metallic material shaped such that flat surfaces thereof face outwardly; and whereby rotation of said body relative to said pin means within said bore causes said pin means to be jammed against a wall of said bore by said camming surfaces such that relative rotation between said shaft and said stud is prevented and said stud rotates with said shaft.

* * * * *